United States Patent [19]

Ulm

[11] Patent Number: 4,991,635

[45] Date of Patent: Feb. 12, 1991

[54] DECAP DISPENSING SYSTEM FOR WATER COOLER BOTTLES

[75] Inventor: John G. Ulm, Loveland, Ohio

[73] Assignee: Liqui-Box Corporation, Worthington, Ohio

[21] Appl. No.: 391,186

[22] Filed: Aug. 9, 1989

Related U.S. Application Data

[63] Continuation-in-part of Ser. No. 251,267, Sep. 30, 1988, Pat. No. 4,874,023.

[51] Int. Cl.[5] ..... B65B 3/04

[52] U.S. Cl. ..... 141/346; 141/286; 141/351; 141/352; 141/353; 141/354; 141/357; 141/363; 141/365; 141/370; 141/383; 62/391

[58] Field of Search ..... 141/346-354, 141/357, 360, 363, 364, 365, 366, 367, 368, 369, 370, 375, 376, 319-322, 383, 384, 387, 286, 82; 62/389, 391; 222/146.6; 312/236

[56] References Cited

U.S. PATENT DOCUMENTS

| | | | |
|---|---|---|---|
| Re. 32,354 | 2/1987 | Savage | 141/349 X |
| 488,473 | 12/1892 | Fruen | 141/352 X |
| 497,896 | 5/1893 | Ruppel | 141/349 X |
| 738,712 | 9/1903 | Cole | 141/349 X |
| 757,170 | 4/1904 | Young et al. | 141/352 X |
| 996,127 | 6/1911 | Patnaude | 141/353 X |
| 1,018,924 | 2/1912 | Patnaude | 141/364 |
| 1,215,310 | 2/1917 | McCrea | 141/375 X |
| 1,228,836 | 6/1917 | Schulse | 141/375 X |
| 1,337,206 | 4/1920 | Doering et al. | 141/375 X |
| 1,538,483 | 5/1925 | Grantham | 141/351 |
| 1,931,973 | 10/1933 | Zerk | 141/357 |
| 1,976,007 | 10/1934 | Cullen et al. | 141/363 |
| 3,343,718 | 9/1967 | Siegel et al. | 141/349 |
| 3,476,507 | 11/1969 | Leeds | 141/348 X |
| 3,871,422 | 3/1975 | Elson et al. | 141/348 |
| 4,253,501 | 3/1981 | Ogle | 141/286 X |
| 4,356,848 | 11/1982 | Spies | 141/349 |
| 4,391,308 | 7/1983 | Steiner | 141/18 |
| 4,421,146 | 12/1983 | Bond et al. | 141/349 |
| 4,445,551 | 5/1984 | Bond et al. | 141/349 |
| 4,717,051 | 1/1988 | Leclerc | 141/364 X |
| 4,815,493 | 3/1989 | Miller et al. | 137/454.5 |
| 4,874,023 | 10/1989 | Ulm | 141/346 |

*Primary Examiner*—Ernest G. Cusick

*Attorney, Agent, or Firm*—Sidney W. Millard; William V. Miller

[57] ABSTRACT

A system for supplying liquid in large bottles from a point where they are filled to a dispenser having a reservoir for receiving the liquid. The bottles each have a neck which carries a cap unit for closing the spout thereof. Each cap unit has an outlet valve that is normally closed. The reservoir has means for supporting another normally closed inlet valve in a neck-receiving socket. When the neck is slipped into the socket the outlet valve of the cap unit is opened and substantially simultaneously the inlet valve for the reservoir is opened thus allowing flow of water from the bottle into the reservoir. When the bottle is removed from the reservoir as the cap unit is withdrawn from the neck-receiving socket, the outlet valve in the bottle neck cap unit is positively closed and the inlet valve of the reservoir automatically closes.

53 Claims, 7 Drawing Sheets

13
14
55
12
16
63
65
64
66
67
69
72
70
71
76
68
72
17
62
20
21
31
88
23
87a
87
91
85
29
30
93
51
18
8
8
36
89
80
100
91
86
84
83
82
81
97
99
31
86a
92
95
98
96
68
75
74
73
61
59
15

DECAP DISPENSING SYSTEM FOR WATER COOLER BOTTLES

This application is a continuation-in-part of Ser. No. 251,267 filed, Sept. 30, 1988, now U.S. Pat. No. 4,874,023, issued Oct. 17, 1989.

BACKGROUND OF THE INVENTION

This invention deals with water or other liquid dispensers of the commercial type each of which has a reservoir from which the cold or hot water is dispensed. The water is supplied in a large bottle which is inverted over the reservoir so that the water flows through the spout of the bottle neck into the reservoir. In the prior art, for delivery and storage the neck is provided with a simple cap. This cap must first be removed and the bottle is then inverted and positioned over the reservoir in communication therewith. The filled bottles are very heavy and as the bottles are inverted it is usual to hold the hand over the spout to prevent loss of substantial amounts of the water. This is difficult to do and is not sanitary. The empty bottles are returned with the spout in the neck open which is unsanitary and makes them more difficult to clean and sanitize.

SUMMARY OF THE INVENTION

The present invention deals with a system whereby the water dealer can supply the water in large capped bottles each of which is closed completely and sanitarily by an outlet-slider valve in a cap applied to the neck thereof that is only opened at the time of inverting the bottle and mounting it on the water dispenser reservoir. The top of the reservoir is closed by a cover or bottle-supporting adaptor which is provided with an upwardly-opening funnel-like bottle neck receiving and supporting socket which receives and seals within it the depending valve-carrying cap on the inverted bottle. This socket carries an inlet valve which comprises a slide stem valve carrying a valve that is normally closed to seal the reservoir. As the capped bottle is inserted in the socket, the stem engages the normally-closed outlet-slider valve in the bottle cap and opens it to permit flow of water from the bottle and substantially simultaneously or an instant before, opens the reservoir sealing inlet valve to permit flow into the reservoir. When the bottle is empty and is removed by withdrawing it from the bottle neck receiving socket, the slider valve in the socket automatically closes and the stem positively activates the slider valve in the cap collar to positively close it. Thus, the bottle is positively closed before return to the dealer. Consequently, the bottle is sealed from the time of leaving the dealer when it is filled to the time of returning to the dealer empty so as to maintain sanitary conditions at all times.

The invention described above is substantially disclosed in the original application Ser. No. 201,267. The present application is directed to improvements on that invention. These include an improved cap and outlet slider valve assembly which permits increased outlet flow, an improved reservoir inlet slider stem valve and probe assembly which locks more positively with the cap outlet valve during opening and closing thereof, an improved adaptor structure for adapting the neck-receiving socket to reservoirs of different diameters, improved sealing means between the cap outlet slider valve assembly and the inlet slider stem assembly when they are in cooperative relationship in the neck-receiving socket, and improved gasket sealing means between the reservoir wall and the socket wall which is inserted therein.

BRIEF DESCRIPTION OF THE DRAWINGS

The best mode contemplated in carrying out this invention is disclosed in the accompanying drawings in which.

DETAILED DESCRIPTION OF THE DRAWINGS

Figure 1:
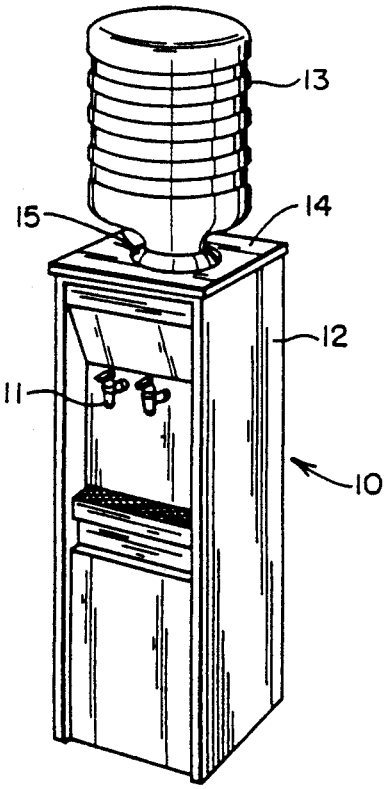
FIG. 1 is a perspective view showing a liquid dispenser to which the invention is applied.

With reference specifically to the drawings, FIG. 1 shows a liquid dispenser 10 as an example of an application of this invention. This dispenser may be of a type to cool heat water or both and to dispense it through faucets such as 11 connected to a reservoir within the cabinet 12. Water or other liquid is supplied by large plastic or glass bottles 13 each of which is successively inserted and mounted on a cover and support plate 14 at the top of the cabinet. This plate carries an adaptor having a bottle neck receiving socket and reservoir inlet valve unit indicated generally by the numeral 15 which is located directly over the liquid or water reservoir 16 shown in FIGS. 6, 7 and 10. The reservoir is supported in the usual manner within the cabinet 12.

The bottle 13 to be inserted in the dispenser 10 is of the usual form having an elongated neck 17 which has a spout 18 which is open at the time of filling the bottle. After filling, the neck 17 receives a cap unit and outlet valve assembly indicated generally by the numeral 20. This assembly is preferably of plastic and is shown best in FIGS. 2 to 4, 4A, 8 and 9. It comprises a cap consisting of an outer flexible skirt 21 which has ribs 22 for frictionally engaging the bottle spout 18 and a flat disk-like top 23 that has a central opening 24. After filling of the bottle 13, the cap is applied and it will be noted (FIG. 4A) that it carries a tamper indicating seal 25 which is of disk-like form that is glued to the top 23 around the opening 24. It is perforated to form a radial tear tab and disc 26 so that when the tab is lifted it will indicate that the cap has been tampered with since the ring part of the seal will remain in place.

Figure 3:
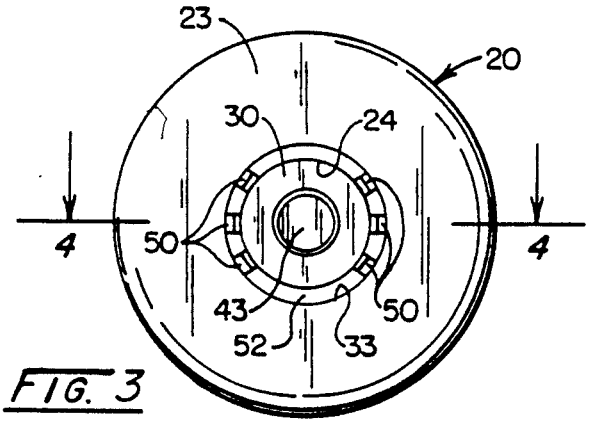
FIG. 3 is a top view of FIG. 2 without its tamper indicating seal.
Figure 3A:
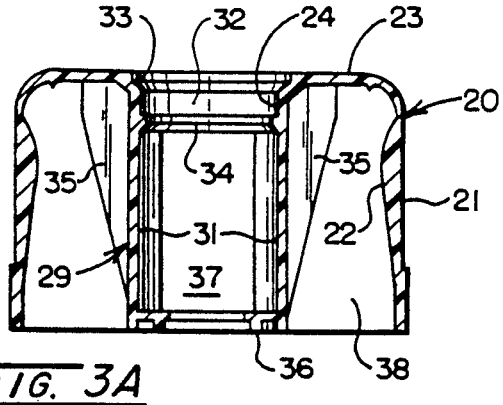
FIG. 3A is a sectional view of the socket part of the cap.
Figure 4A:
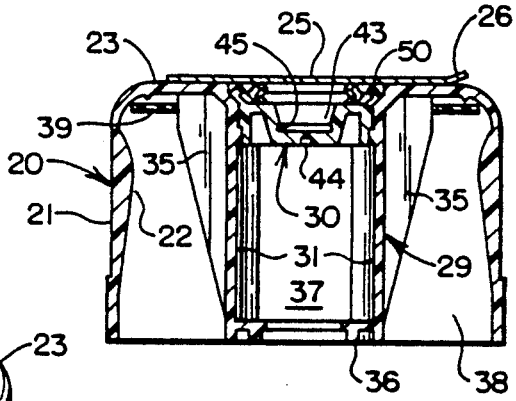
FIG. 4A is a sectional view of the assembled cap.
Figure 2:
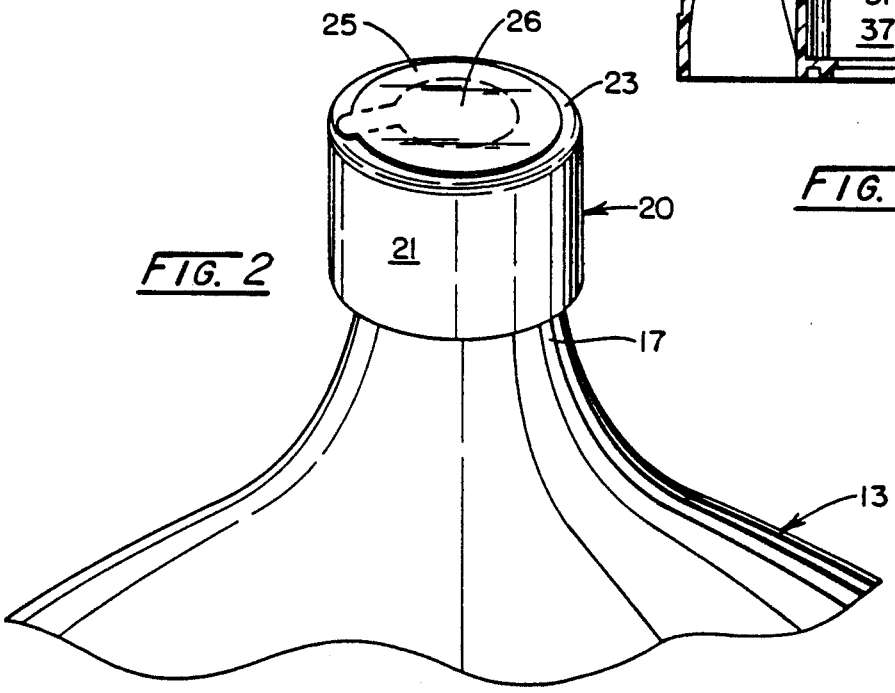
FIG. 2 is an enlarged view of the neck portion of one of the bottles with the cap and valve assembly of the invention applied thereto.
Figure 4:
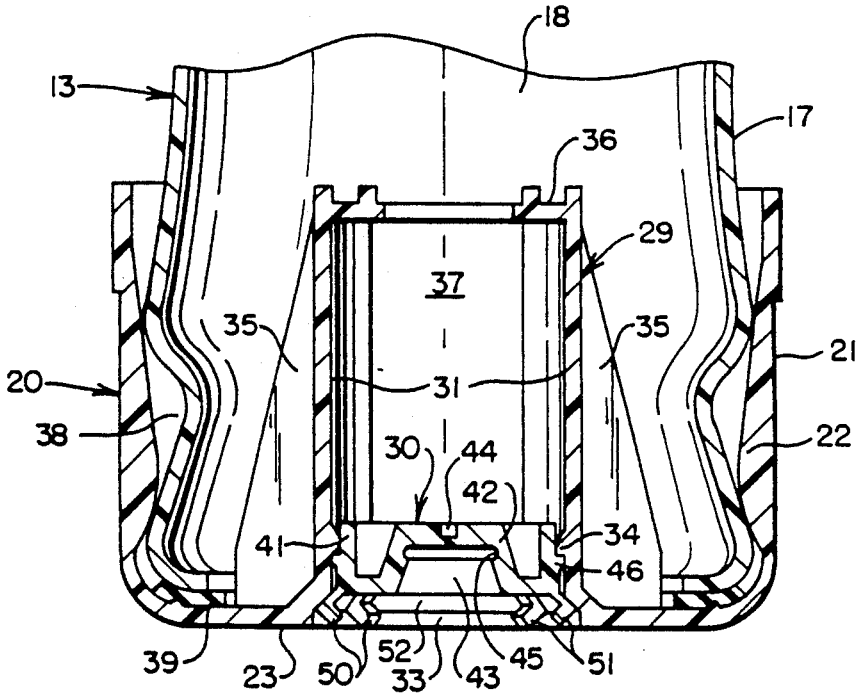
FIG. 4 is a cross section taken along 4—4 of FIG. 3.
Figure 5:
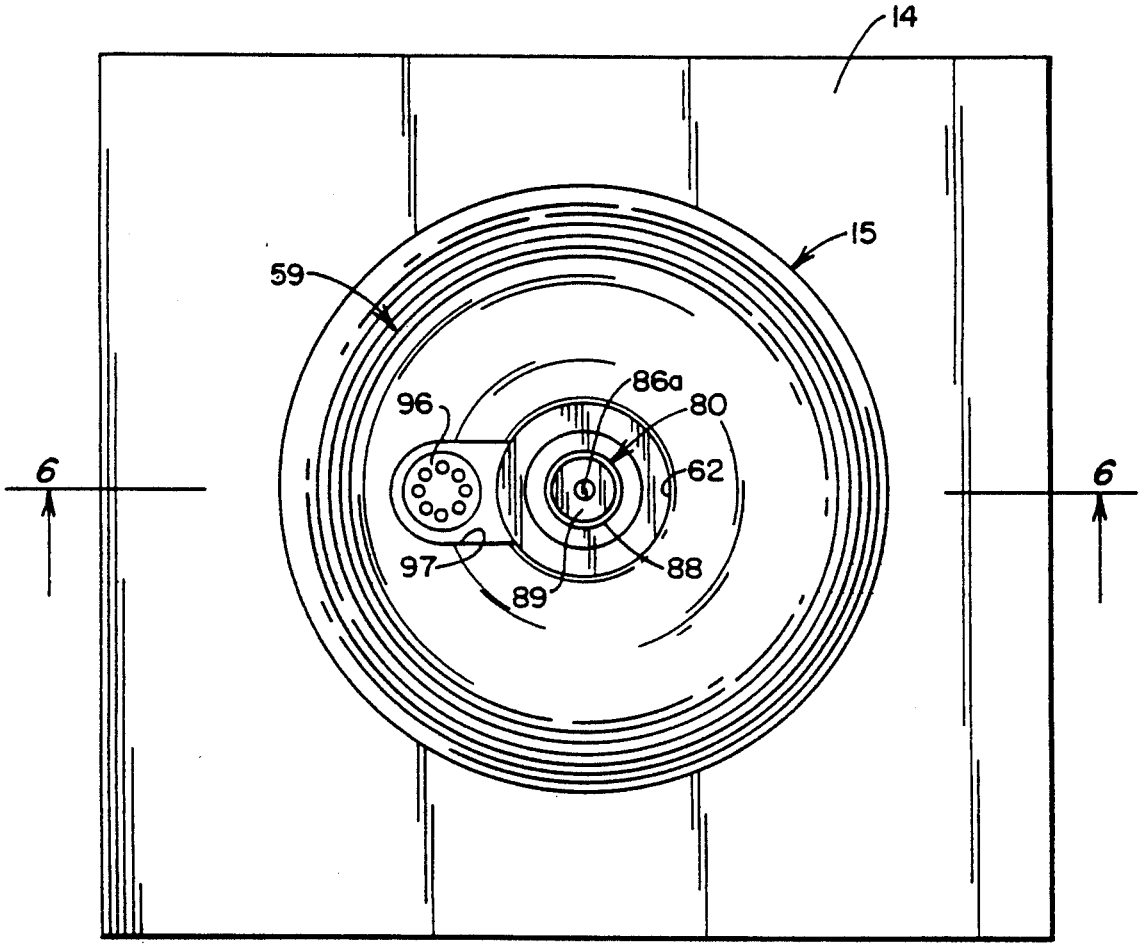
FIG. 5 is a plan view of the adaptor with its bottle-receiving socket and valve assembly mounted at the top of the reservoir of the dispenser.

The valve of the assembly 20 comprises a slider valve member 30 which is concentrically supported in the skirt 21 for axial sliding movement by means of a guide structure 29 which includes a pair of diametrically disposed guides 31 which depend from the top 23 of the cap skirt 21. Each of these guides 31 is of arcuate cross-section (FIG. 9) and is integral with a ring 32 that surrounds the opening 24. This ring has an outwardly-flared annular cam shoulder 33 at its upper side around the opening 24 and a slider positioning groove 34 spaced axially inwardly therefrom as shown best in FIG. 3A. Each of the guides 31 is reinforced by gussets 35 extending between the guides and the top 23 of the cap. The lower ends of the guides 31 are connected integrally to a support ring 36 which is concentric with the opening 24. With this arrangement a support guide structure 29 is provided for slider valve 30 which has a pair of diametrically opposed passageways 37 between the guides 31 and it will be noted that these passageways extend the full length of the guide structure 29 so as to provide for full flow from the cap when the slider valve 30 is moved to its fully opened position shown in FIG. 7. It will also be noted that an annular spout-receiving socket 38 is provided between the skirt 21 and the gussets 35 and that this has a wide mouth but converges inwardly, so as to tightly receive the spout. A gasket 39 is provided for producing a seal at the lip of the spout 17 when the cap is positioned on the spout as shown in FIG. 4.

The slider valve 30 is of annular disk-like form to fit for sliding movement in the arcuate guides 31 and is of much less axial extent than the guides so that when moving into open position, the outlet passageways 37 will be substantially unobstructed. It comprises a body which has an outer annular guide engaging flexible flange 41 and an inner flange 42 which tapers toward its axis so as to provide an outwardly opening flared stem-receiving socket 43. The inner side of the slider 30 has a transverse slot 44 which can be used to rotate the valve member in the guide structure 29 by means of a suitable tool. The socket 43 has an annular probe-retaining groove 45 formed in its wall. On the outer surface of the flange 41 of the slider 30 is an annular rib 46 which is adapted to snap into the locating groove 34 when the slider is in closed position as shown in FIG. 4. This provides a retaining force which tends to keep the valve 30 in closed position but which can be overcome by positive inward or upward pressure on it.

The lower or outer surface of the slider valve 30 carries two sets of resilient gripping fingers 50, each set being positioned initially in alignment with a guide 31 by turning the valve so as to engage a guide as the slider is moved axially inwardly between the guides during opening. Each finger is provided with a locking lug 51 at its outer extremity. These fingers are normally biased to their outer positions in engagement with the outwardly-spaced cam surface 52 of the ring 32 to retain the slider 30 in closed position as shown in FIG. 4. The outer flange 41 of slider 30 is provided with peripheral arcuate guide flanges 43*c* which cooperate with the edges of guides 31 in the outlet passageways 37 (FIG. 9) to prevent rotation of the slider once it is positioned properly within the guide structure 29 so that the sets of gripping fingers 50 are located properly to cooperate with the guides.

Figure 6:
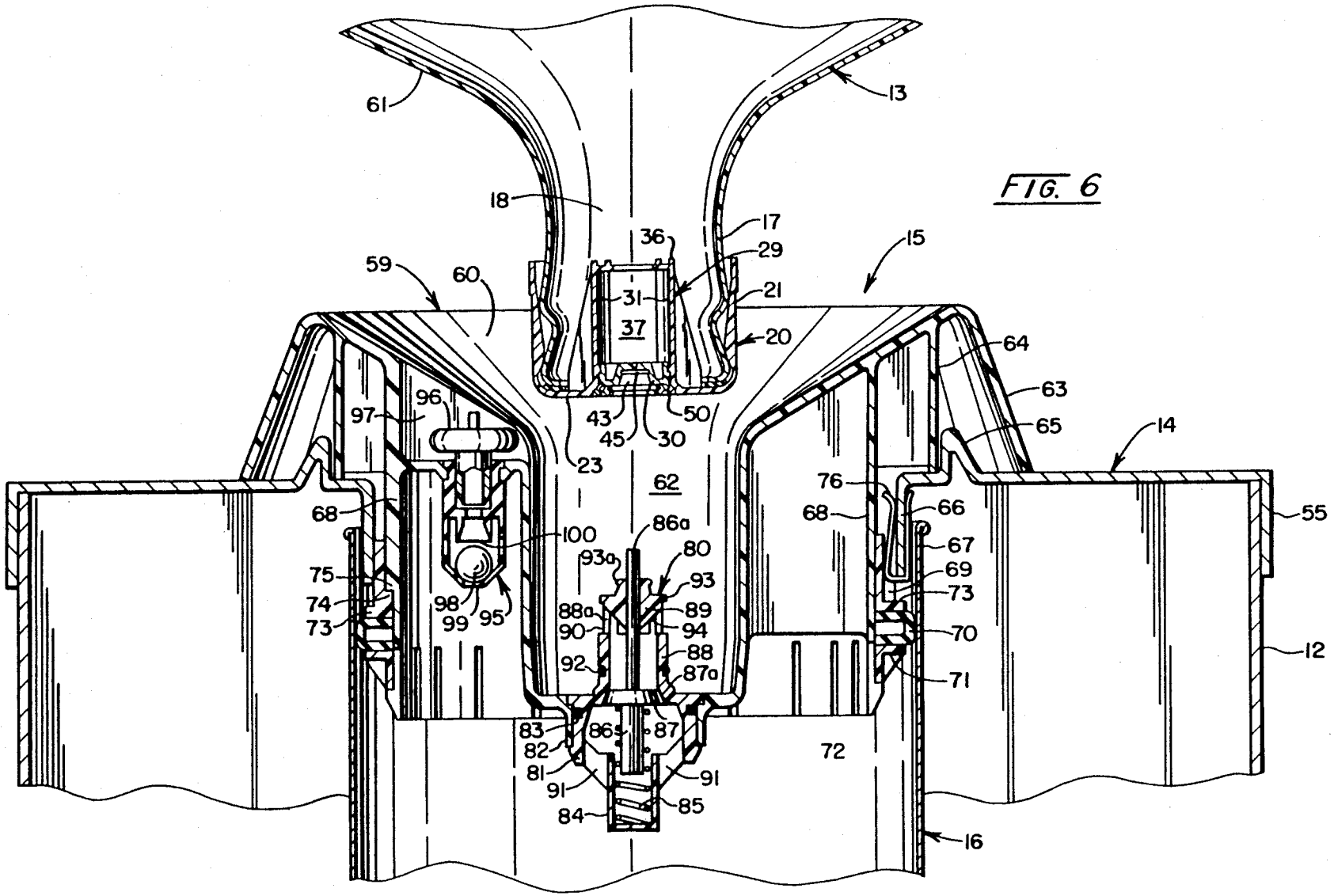
FIG. 6 is an enlarged sectional view taken along line 6—6 of FIG. 5 showing the capped bottle being inserted in the socket above the reservoir.
Figure 7:
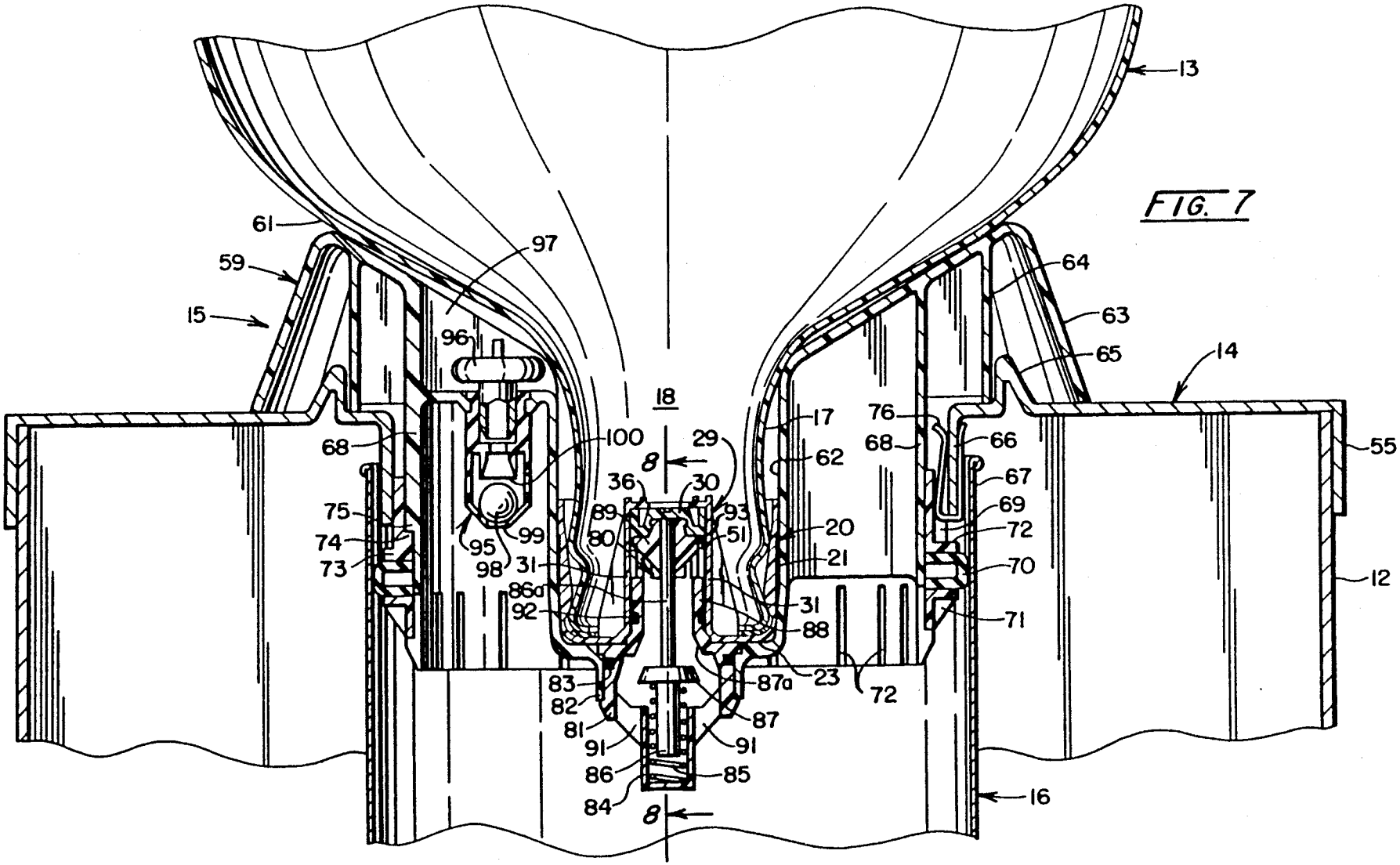
FIG. 7 is a similar view showing the inserted bottle in the receiving socket on the adaptor.
Figure 8:
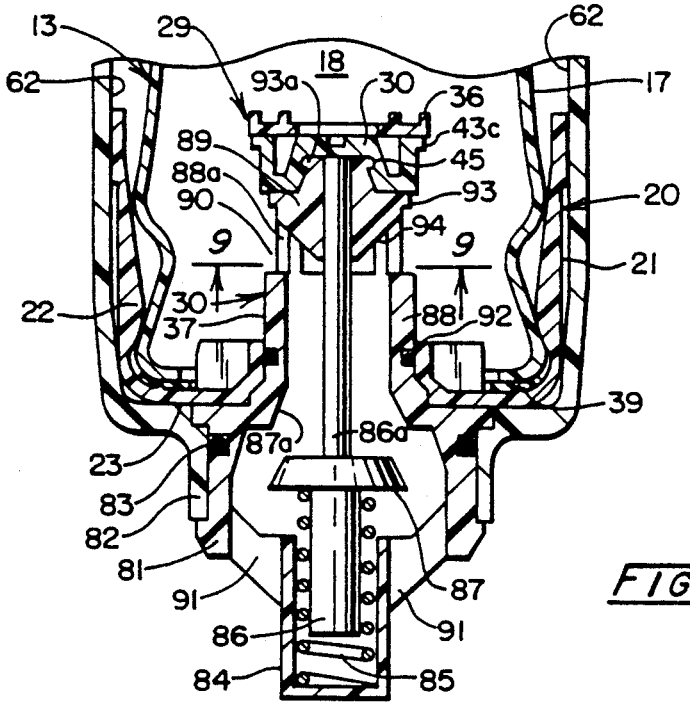
FIG. 8 is an enlarged sectional view taken along line 8—8 of FIG. 7 through the reservoir inlet valve.
Figure 9:
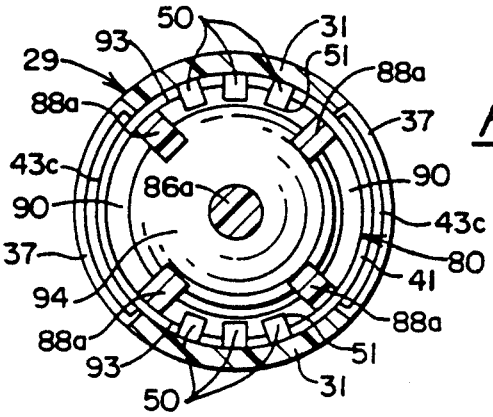
FIG. 9 is a section taken along line 9—9 of FIG. 8.

As indicated, the cover and support plate 14 is adapted to support the bottle neck 17 in association with the reservoir 16 as shown in FIG. 7 after insertion of the bottle in the socket and valve assembly unit 15 from the position shown in FIG. 6. This plate 14 has a depending peripheral flange 55 which extends downwardly into overlapping relationship with the wall of cabinet 12 and may be suitably secured thereto as shown in FIGS. 6 and 7. This plate supports the bottle neck socket and associated reservoir inlet valve assembly unit 15 as previously indicated. This unit which is preferably of plastic is of funnel form and comprises an adaptor 59 with upper adaptor portion 60 which will receive and support the curved upper portion 61 of the bottle 13 which merges with the neck 17 of the bottle. It will be obvious that this portion 60 of the adaptor can receive and support bottle portions 61 of various diameters. The adaptor portion 60 merges with the depending neck-receiving socket 62 which is of tubular form. The adaptor 59 is provided with a pair of depending annular outer flanges 63 and 64 which rest in the plate 14 on opposite sides of an upstanding annular centering rib 65 which engages the flange 64 to center the adaptor relative to the reservoir 16 flange 63 being angled outwardly radially. Radially inwardly of the rib 65 the plate 14 has an annular depending skirt 66 which depends into the reservoir 16 into overlapping relationship with its annular wall 67. The adaptor 59 also has a depending annular skirt 68 which extends downwardly into the reservoir 16 in spaced relationship to the wall 67 thereof so that the space can receive the annular C-shaped gasket 70 which is adapted to be expanded into sealing engagement with the reservoir wall 67 and the adaptor skirt 68 as shown best in FIG. 10. This gasket has its lower side in engagement with a support and pressure ring 71 that is carried by skirt 68. Skirt 68 is provided with vertical slits 72, although wider slits may be provided, to facilitate positioning of the gasket initially on the skirt. The upper side of the gasket 70 is engaged by a cam ring 73.

Figure 10:
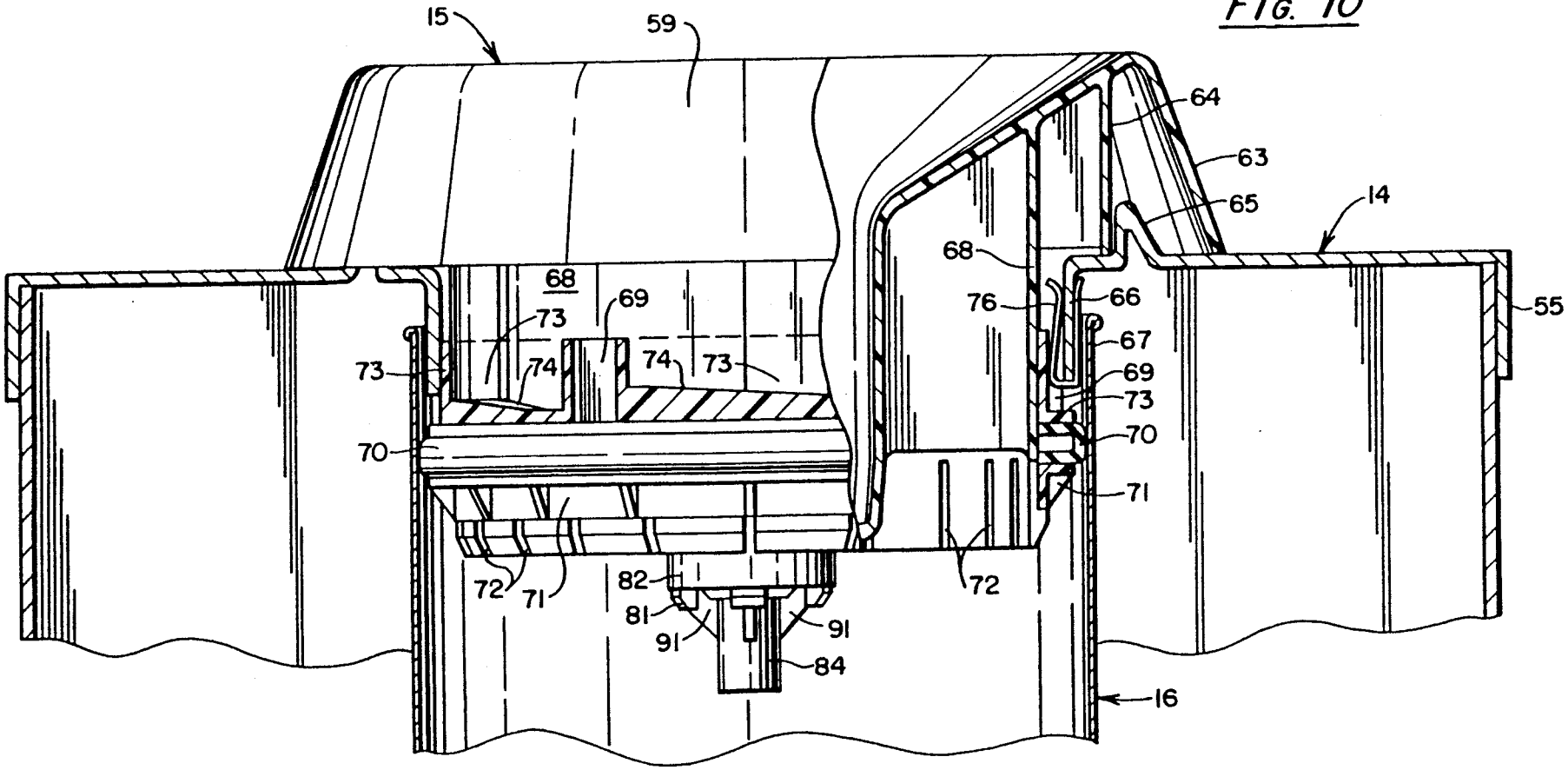
FIG. 10 is a partial sectional view of the bottle-receiving adaptor.

The spacing of the skirt 68 within the surrounding concentric wall 67 of the reservoir 16 may vary in different models of dispensers, and means is therefore provided to expand the gasket 70 carried by skirt 68 into contact with the surrounding reservoir wall to provide a tight hermetic seal. For this purpose means is provided for producing relative axial sliding movement of the cam ring 73 on the skirt 68 after the unit 15 is initially positioned on plate 14 over the reservoir 16. This will cause the gasket 70 to be compressed vertically to expand it radially outwardly into tight contact with the wall 67 of reservoir 16 as shown in FIGS. 6, 7 and 10. This may be accomplished by means of inclined cams 74 on the ring 73 and reversely inclined cams 75 on the skirt 68 so that if the adaptor 59 is rotated the gasket will be compressed since depending clips 76 are provided on depending flange 66 of the adaptor and within notches 69 of cam ring 73 to prevent rotation of cam ring 73 when the adaptor is rotated relative to the reservoir.

As indicated previously, the unit 15 includes the neck-receiving socket 62 and this socket has mounted at its bottom a reservoir inlet valve indicated generally by the numeral 80 in FIGS. 6, 7, 8 and 10. The valve is carried by a fitting 81 which is mounted on a boss 82 at the bottom of the socket 62 and is sealed therein by an O-ring 83. This fitting has a depending chamber 84 in which a compression spring 85 is disposed that has an upper portion surrounding the lower end of a valve stem 86. This stem 86 is part of a slider valve which includes a valve head 87 that is normally seated by the spring 85 on a valve seat 87*a* in an upstanding probe support tube 88 of fitting 81 which surrounds the reservoir inlet opening. The stem 86 has a reduced upward extension 86*a* above the valve head and this slidably extends through a probe head 89 fixed on the upper end of tube 88 by four posts 88*a* forming inlets 90. This tube provides a probe extending upwardly into the neck-receiving socket 62 and which carries the head 89 for activating the slider valve 30 in the manner described below. The probe head has an annular shoulder 93 projecting outwardly and has a tapered lower surface 94 below it for directing liquid through the inlets 90 provided below the probe head. Liquid will flow through these inlets from the opened valve 30 and, when the valve head 87 is unseated, past the valve head 87 and through inlet openings 91 at the bottom of fitting 81 into the reservoir 16. When the valve head 87 is seated the stem 86 will project upwardly through the probe head 89 as shown in FIG. 6. An O-ring 92 is mounted on tube 88 adjacent the bottom of socket 62.

An air filter and check valve unit 95 is located on the adaptor 59. The filter 96 is in an open chamber 97 at the upper side of the adaptor for admitting air when needed. The ball 98 of the check valve normally rests on a lower seat 99 but if the liquid level rises in the reservoir it will float and seat on an upper seat 100 to prevent overflow from the reservoir 16. Different types filter and check valve units may be provided.

In use of the system, the bottle 13 is filled and the cap and valve unit 20 is then applied by forcing it onto the neck 17. Before applying to the bottle, the unit 20 will be as shown in FIG. 4A with tamper indicating seal 25 in place. The cap 20 contains the slider valve 30 which will be closed at this time with the fingers 50 in engagement with cam surface 52. As indicated initially, the slider valve 30 is rotated about its axis by a tool applied to slot 44 to position the locking fingers 50 for cooperating with guides 31 and to snap the peripheral flanges 43*c* into passageways 37 to be retained by the edges of guides 31. Thereafter, valve 30 will remain in this rotated position even when sliding vertically on guides 31. The cap and valve 20 on the bottle assures minimum leakage and maximum sanitation during storage and dispensing.

The bottle neck receiving socket and reservoir inlet valve unit 15 is applied to the reservoir 16 initially by positioning the adaptor 59 on the plate 14 with the skirt 68 thereof extending into the reservoir as shown in FIG. 6. The adaptor is then rotated on the plate 14 to compress the gasket 70 as indicated. This causes the gasket to expand radially to tightly seal between the wall 67 of the reservoir 16 and the skirt 68 of the adaptor 59 to hermetically seal the unit 15 in the reservoir 16. At this time the valve stem 86 is biased by the spring 85 so that the valve head 87 is seated and the stem extension projects upwardly from the probe head 89. The check valve 98 will close to prevent overflow from the reservoir 16 if necessary. Air will be admitted as needed through filter 96. This air handling system is important for controlling reservoir overflow which may be caused after the bottle neck is inserted in unit 15 by cracked bottles admitting make-up air. If the crack is located on the bottle so it will admit air without leaking liquid, the liquid will not exit the reservoir 16 and overflow because of the hermetic seal between the reservoir 16 and the unit 15 which is also maintained at the valve 95 until make-up air is needed.

In positioning the filled and capped bottle 13 on the unit 15 carried by plate 14, the bottle 13 is inverted as shown in FIG. 6 and is positioned centrally over the upper adaptor portion 60 and, as the bottle is lowered, the neck 17 will be guided thereby into the neck-receiving socket 62. At this time the reservoir inlet valve 80 will be closed with valve body 87 seated and the stem 86*a* projecting upwardly through probe head 89. As the neck 17 drops into the tubular socket 62 it fits tightly therein to prevent tilting of the bottle since the cap skirt 21 will frictionally engage the tubular wall of the socket. The neck will drop in until the cap top 23 rests on the bottom of the socket 62 as shown in FIG. 7. As the bottle neck 17 passes down into the socket 62, the upper end of the valve stem 86*a* enters the downwardly opening socket 43 in slider valve 30 which moves the valve head 87 off the seat 87*a*. The probe head 89 then snaps into the slider valve 30 pushing it up. In doing this the flexible gripping fingers 50 are engaged by the cam surface 52 of the ring 32 to swing them radially inwardly and they will be held in this position by the valve 30 sliding along the guides 31 with its two sets of fingers in engagement with the surfaces of guides 31. It will be apparent that valve 30 is positively held in closed position (FIG. 4) until the fingers 50 swing radially inwardly. Upward movement of valve 30 by probe head 89 opens the passageways 37 so that liquid can flow through said passageways and downwardly through the cap ring 32. As opening of valve 30 occurs, the socket 43 of the valve 30 moves downwardly over the probe head 89 until its retaining ring 93*a* snaps into the retaining groove 45 on the valve. Thus, probe head 89 is positioned in socket 43 unless positively pulled therefrom. At the same time the locking lugs 51 on the flexible fingers 50 are swung beneath the annular shoulder 93 on the probe head 89 to positively lock the valve 30 to the probe head. Thus, the slider valve 30 is first opened by contact of the upper end of the probe head 89 therewith and slightly before that the valve 87 is unseated by stem 86 by contacting valve 30 to permit the liquid to flow from the bottle 13 through relatively unrestricted passageways 37 and then out through tube (FIG. 8) 88 past unseated valve head 87 to the reservoir through the inlets 91. As the valve 30 moves upwardly in the guides 31 they move down over the O-ring 92 to provide a seal between those members.

When the bottle is removed by pulling its neck 17 upwardly from the socket 62, the spring 85 moves the stem 86 automatically upwardly to seat the valve head 87 and the slider valve 30 is moved positively into closed position by the interfitting valve probe 89 positively pulling the valve 30 axially outwardly into closed position due to its positive connection thereto through the gripping fingers 50 having their locking lugs 51 positioned beneath the projecting shoulder 93 on the probe head 86 and the snap fit of the retaining ring 93*a* in the groove 45 of the socket 43 in valve 30. Thus, the outlet valve 30 in the cap 20 is positively closed when the bottle 13 is removed from the reservoir 16. Consequently, the clean and sanitary facilities are continued after the bottle 13 is empty and removed from the dispenser 10 in that the cap valve 30 is closed and deters the invasion of vermin, insects and bacteria. Bottles returned with the cap 20 removed will immediately cause suspicion as to the possibility that the bottle has been used to contain other undesirable liquids. The cap 20 is designed to be almost impossible to remove intact but may be removed by a suitably designed decapitator.

It will be apparent from the above that this system uses a cap and valve assembly which hermetically seals the bottle until it is to be positioned in cooperation with the reservoir of the dispenser. This cap assembly includes the normally-closed bottle outlet valve in the form of a slider valve member. The cap outlet valve is automatically opened when the neck of the inverted bottle is inserted into a socket leading into the reservoir and becomes hermetically sealed in that socket. That socket is provided with a slidable valve stem to engage the cap slider valve to open it and which also controls substantially simultaneously the unseating of a reservoir inlet stem valve to permit flow of liquid from the bottle into the reservoir. When the bottle neck is withdrawn from the reservoir socket, the slider valve in the cap is positively moved to closed position and the reservoir inlet stem valve is allowed to close.

Figure 11:
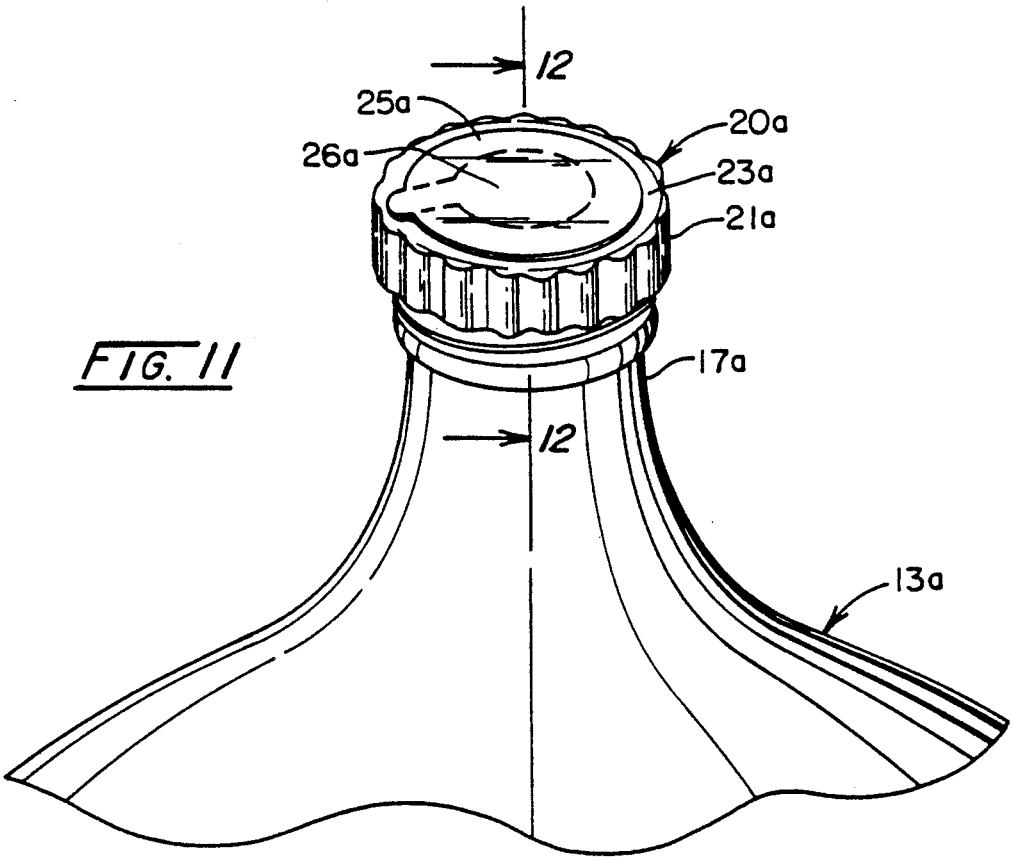
FIG. 11 is a perspective view of the neck of a bottle with a screw cap thereon which carries the outlet valve assembly.
Figure 12:
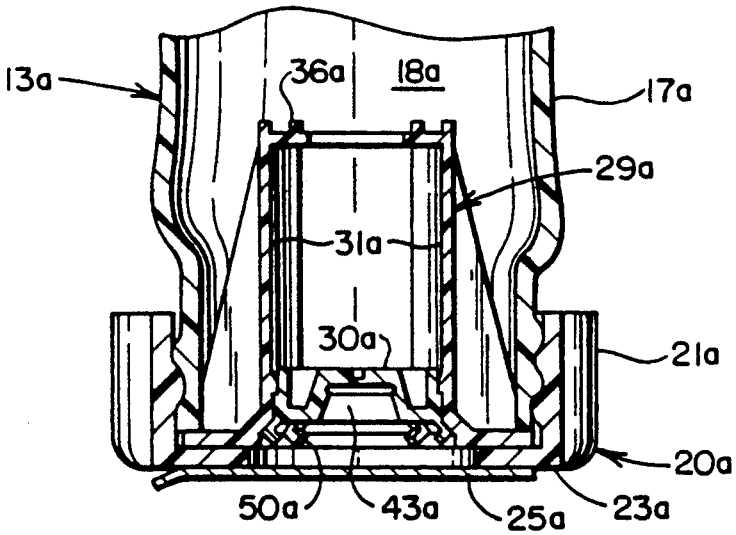
FIG. 12 is an enlarged sectional view taken along line 12—12 of FIG. 11.

In FIGS. 11 and 12 the cap and outlet valve unit 20*a* is shown as comprising a screw cap 21*a* which screws onto the threaded neck 17*a* of the bottle 13*a*. The slider valve 30*a* is exactly as before and slides in the guides 31*a*. Corresponding numbers with a suffix "a" designate similar parts. The function will be the same as the valve previously described.

Figure 13:
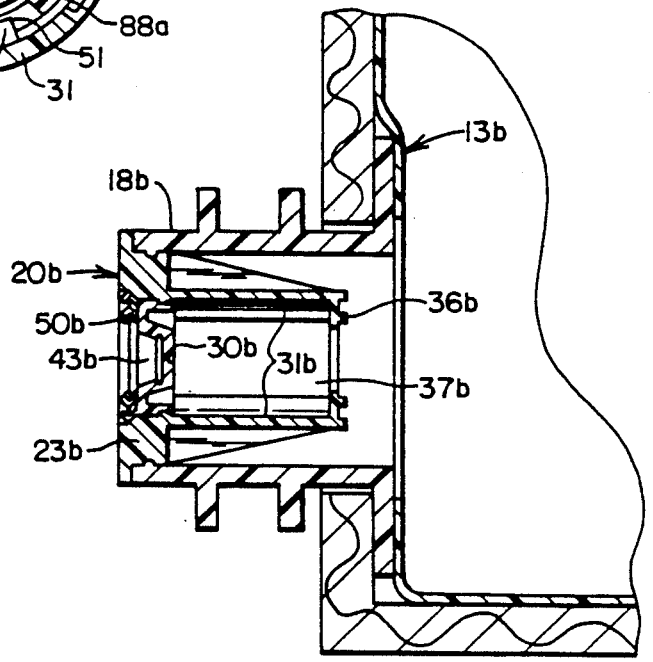
FIG. 13 is a section showing a bottle outlet valve assembly mounted in the spout of a bag-in-box.

FIG. 13 illustrates the outlet valve structure 20*b* disposed directly within a spout 18*b* which may be on a bag 13*b* of a bag-in-box package. The slider valve 30*b* is exactly as before but may be carried by a disk 23*b* which is snapped into the end of the spout 18*b*. Other parts similar to the previously described assembly are indicated by corresponding numerals with the suffix "b". This valve functions the same as those previously described.

This system provides a method whereby the bottle is hermetically sealed after filling and until it is mounted on the top of the dispenser reservoir which itself is hermetically sealed until the neck of the bottle is inserted in the socket associated therewith. At that time the outlet valve on the bottle is automatically opened while substantially simultaneously the inlet valve for the reservoir is opened. Upon removal of the bottle from the dispenser the inlet valve of the reservoir closes and the outlet valve of the bottle is positively closed. Thus, sanitary conditions are maintained from the filling of the bottle until its return.

What is claimed is:

1. In combination a container for liquid having a projecting neck through which the liquid contents is to be dispensed and a dispenser having a reservoir for receiving said liquid when the container is inverted thereon;

a cap and outlet valve assembly in said neck, said assembly comprising a cap carrying a guide structure and an annular slider outlet valve, said slider valve being mounted for sliding movement along said guide structure between a normally-closed position and an opened position; said guide structure having a length, being mounted on said cap and extending into the neck, means forming elongated outlet passages along said length, said guide structure comprising at least two arcuate surfaces engaging said slider outlet valve, said slider outlet valve having a length of substantially lesser extent than said passages to permit flow through said passages as the valve moves toward said opened position, a socket and inlet valve assembly mounted in cooperation with said reservoir, said socket and inlet valve assembly comprising an upwardly-opening neck-receiving socket having an axis which receives the neck of said container when inverted, said inlet valve including a valve stem carrying a valve body which is normally biased to closed position, a reservoir inlet leading from the said upwardly-opening socket into said reservoir and closed by said valve body when in closed position, a tubular probe coaxially mounted with an extending upwardly in said upwardly-opening socket, said valve stem being axially slidably mounted in said probe, said valve stem projecting upwardly from the probe so as to engage said slider outlet valve in the container neck when the neck is inverted in the upwardly-opening socket to move said slider outlet valve into said opened position, engagement of the stem with said slider outlet valve also moving the stem downwardly in said probe to move said valve body carried thereby into said opened position form said normally-biased closed position, resilient gripping fingers on said slider outlet valve for engaging the guide structure to normally hold the outlet valve in said normally-closed position, said fingers being arranged in groups annularly spaced to align with said guide structure, said slider outlet valve having guide structure engaging means projecting into each of said passages for engaging the guide structure to prevent rotation of said outlet valve to keep the groups of fingers in alignment with said guide structure.

2. The combination of claim 1 in which said guide structure and annular slider outlet valve have interengaging means intending to hold the annular slider outlet valve in said normally-closed position.

3. The combination of claim 1 in which said guide structure consists of a pair of diametrically opposed guides with diametrically opposed passages therebetween.

4. The combination of claim 1 in which said guide structure is carried on an outer ring, said slider outlet valve and said guide structure having interengaging means in the form of a cooperating groove and a rib snapped into the groove tending to hold the slider outlet valve in said closed position.

5. The combination of claim 1 in which said slider outlet valve projecting means for engaging said guide structure comprises peripheral projecting shoulders extending into each of said passages.

6. The combination of claim 5 in which said guide structure is carried by an outer ring having an outlet opening normally closed by said outlet valve, said resilient gripping fingers being biased to engage said ring to normally hold the outlet valve in said normally closed position.

7. The combination of claim 6 in which said fingers are flexibly connected at inner end to the outlet valve and have inwardly projecting probe-engaging lugs on their outer ends.

8. The combination of claim 7 in which said slider outlet valve has an upwardly opening probe-receiving socket at its lower side.

9. The combination of claim 8 in which the probe-receiving socket has an annular wall with a probe retaining groove in said wall, and a retaining ring on said probe for entering said groove when said probe enters said probe-receiving socket.

10. The combination of claim 6 in which the fingers are in two diametrically opposed groups on said outlet valve, said guide structure comprising a pair of arcuate cross-section guides providing said arcuate surfaces supported by said outer ring at diametrically opposed locations corresponding to the said groups of fingers.

11. The combination of claim 10 in which said fingers are normally biased outwardly into engagement with said outer ring, said ring having a cam surface which engages said fingers as they move upwardly with the outlet valve when it is moved to said opened position.

12. The combination of claim 10 in which the said guides have edges exposed at said outlet passages, said peripheral projecting shoulders engaging with said edges at each passage.

13. The combination of claim 12 in which the outlet valve is of disk-like form and said probe-receiving socket opens downwardly at its lower side and has a tool-receiving slot at its upper side.

14. The combination of claim 1 in which the probe includes an upstanding tubular support in said upwardly-opening neck-receiving socket that has the said slider valve stem mounted therein for downward movement, an annular valve seat on said support, said inlet valve body being carried by said stem for normally seating upwardly on said valve seat, said support having inlet means above said valve seat.

15. The combination of claim 14 in which said probe has a head mounted on said upstanding support, said slider outlet valve having a downwardly-opening socket, said head being adapted to fit in said downwardly opening socket in said slider outlet valve, said upwardly projecting stem also extending into said slider outlet valve socket before the probe head enters therein upon insertion of the container neck in said neck-receiving socket.

16. The combination of claim 15 in which said probe head has finger-engaging locking means engaged by said resilient gripping fingers carried by said slider outlet valve as it is pushed into said opened position by said stem and probe head.

17. The combination of claim 16 in which said locking means is on said probe head and is engaged by inwardly projecting locking lugs on said fingers.

18. The combination of claim 17 in which said cap has an outer ring and said guide structure comprises guides carried by said outer ring which has an outlet opening, said gripping fingers being normally biased to engage said ring and hold the outlet valve in closed position, said ring having a cam surface for moving the locking lugs into locking engagement with said finger-engaging locking means on the probe head.

19. The combination of claim 1 in which the said socket and inlet valve assembly includes an adaptor of funnel shape having a flared socket portion, a container neck-receiving portion of tubular form adapted to fit the said tubular neck of a container leading from said flared socket portion, said inlet valve being disposed in said tubular neck-receiving portion for controlling said inlet which leads therefrom into the reservoir.

20. The combination of claim 19 in which said probe is in the form of a tube upstanding from an inlet in the bottom of said tubular neck-receiving portion leading into said reservoir, said valve body seating upwardly on a seat on said probe and biasing means in the form of a compression spring normally urging said valve stem upwardly.

21. The combination of claim 20 in which the probe head is of annular form and has outlets disposed around the head leading into said tubular probe, said probe head having a tapered lower surface for directing liquid from said outlets.

22. The combination of claim 20 in which said reservoir has an annular wall and opens upwardly, and means on the reservoir for engaging said adaptor for centering said adaptor relative to said reservoir annular wall, said neck-receiving socket being of tubular form and extending into said reservoir concentric with said annular wall.

23. The combination of claim 22 in which the adaptor has a depending annular skirt which depends into said reservoir and is concentric with said annular wall so that there is an annular space between said skirt and said wall, and means disposed in said space for sealing said space.

24. The combination of claim 23 in which said sealing means is in the form of a flexible gasket expandable into tight engagement with the annular skirt and annular wall, and means for expanding the gasket, said expanding means comprising means for producing relative axial movement between the annular skirt and the annular wall.

25. The combination of claim 24 in which said means for producing relative axial movement includes reversely-inclined cams carried by the annular skirt and the annular wall.

26. The combination of claim 25 in which the gasket is of C cross-section with upper and lower flexible sides which are compressed towards each other in expanding the gasket between said annular skirt and annular wall.

27. The combination of claim 26 in which said gasket has flexible upper and lower sides and is non-rotatably positioned on the said annular skirt by a positioning ring located at a fixed axial position thereon and which engages the gasket at its lower side and a gasket-compressing ring fixed axially relative to said annular wall and surrounding said skirt to permit axial movement of the skirt relative to said ring and engaging the gasket at the said upper side.

28. In combination a container for liquid having a projecting neck through which the liquid contents is to be dispensed and a dispenser having a reservoir for receiving said liquid when the container is inverted thereon;

a cap and outlet valve assembly in said neck, said assembly comprising a cap carrying a guide structure and an annular slider outlet valve, said slider outlet valve being mounted for sliding movement along said guide structure between a normally-closed position and an opened position; said guide structure having a length, being mounted on said cap and extending into the neck, means forming elongated outlet passages along said length, said guide structure comprising at least two arcuate surfaces engaging said slider outlet valve, said slider outlet valve having a length of substantially lesser extent than said passages to permit flow through said passages as the valve moves toward said opened position, a socket and inlet valve assembly mounted in cooperation with said reservoir, said socket and inlet valve assembly comprising an upwardly-opening neck-receiving socket having an axis which receives the neck of said container when inverted, said inlet valve including a valve stem carrying a valve body which is normally biased to closed position, a reservoir inlet leading from the said upwardly-opening socket into said reservoir and closed by said valve body when in closed position, a probe coaxially mounted with and extending upwardly in said upwardly-opening socket, said valve stem being axially slidably mounted in said probe, said valve stem projecting upwardly from the probe so as to engage said slider outlet valve in the container neck when the neck is inverted in the upwardly-opening socket to move said slider outlet valve into said opened position, engagement of the stem with said slider outlet valve also moving the stem downwardly in said probe to move said valve body carried thereby into said opened position from said normally-biased closed position, said guide structure comprising inwardly extending elongated guides having said arcuate guide surfaces with said outlet passages therebetween, said inwardly extending guides being of arcuate cross-section annularly spaced with said outlet passages therebetween, said inwardly extending guides consisting of a pair of diametrically opposed guides with diametrically opposed passages therebetween, said guides being carried on an outer ring, said slider outlet valve and guides having interengaging means in the form of a cooperating groove and a rib snapped into the groove tending to hold the slider outlet valve in said closed position.

29. The combination of claim 28 in which said slider outlet valve has peripheral projecting shoulders extending into each of said passage for engaging the said pair of guides.

30. The combination of claim 28 in which said slider outlet valve carries resilient gripping fingers for engaging the guide structure to normally hold the valve in said normally-closed position.

31. The combination of claim 28 in which the container has a neck with screw threads and the cap has cooperating threads, said elongated guide structure being carried by the screw cap and extending inwardly therefrom.

32. The combination of claim 28 in which the cap is carried directly by the neck of the container and said guide structure is carried by the cap and extends inwardly into the spout.

33. In combination a container for liquid having a projecting neck through which the liquid contents is to be dispensed and a dispenser having a reservoir for receiving said liquid when the container is inverted thereon;

a cap and outlet valve assembly in said neck, said assembly comprising a cap carrying a guide structure and an annular slider outlet valve, said slider outlet valve being mounted for sliding movement along said guide structure between a normally-closed position and an opened position; said guide structure having a length, being mounted on said cap and extending into the neck, means forming elongated outlet passages along said length, said guide structure comprising at least two arcuate surfaces engaging said slider outlet valve, said slider outlet valve having a length of substantially lesser extent than said passages to permit flow through said passages as the valve moves toward said opened position, a socket and inlet valve assembly mounted in cooperation with said reservoir, said socket and inlet valve assembly comprising an upwardly-opening neck-receiving socket having an axis which receives the neck of said container when inverted, said inlet valve including a valve stem carrying a valve body which is normally biased to closed position, a reservoir inlet leading from the said upwardly-opening socket into said reservoir and closed by said valve body when in closed position, a probe coaxially mounted with and extending upwardly in said upwardly-opening socket, said valve stem being axially slidably mounted in said probe, said valve stem projecting upwardly from the probe so as to engage said slider outlet valve in the container neck when the neck is inverted in the upwardly-opening socket to move said slider outlet valve into said opened position, engagement of the stem with said slider outlet valve also moving the stem downwardly in said probe to move said valve body carried thereby into said opened position from said normally-biased closed position, said guide structure comprising inwardly extending elongated guides having said arcuate guide surfaces with said outlet passage therebetween, said annular slider outlet valve engaging said arcuate guide surfaces and being of substantially lesser axial extend than said guides and passages, said inwardly extending guides being of arcuate cross-section to provide said arcuate guide surface and annularly spaced to provide said elongated outlet passages therebetween, said arcuate guides being carried by an outer ring having an outlet opening normally closed by said outlet valve, said outlet valve having resilient gripping fingers biased to engage said ring to normally hold the outlet valve in said normally closed position.

34. The combination of claim 33 in which the said fingers are flexibly connected at inner ends to the outlet valve and have inwardly projecting probe-engaging lugs on their outer ends.

35. The combination of claim 33 in which said annular slider outlet valve has an upwardly opening probe-receiving socket at its lower side.

36. The combination of claim 35 in which the probe-receiving socket has an annular wall with a probe retaining groove in said wall, and a retaining ring on said probe for entering said groove when said probe enters said probe-receiving socket.

37. The combination of claim 33 in which said fingers are in two diametrically opposed groups on said outlet valve, said arcuate cross-section guides being supported by said ring at diametrically opposed locations corresponding to the said groups of fingers.

38. The combination of claim 37 in which said fingers are normally biased outwardly into engagement with said ring, said ring having a cam surface which engages said fingers as they move upwardly with the outlet valve when it is moved to said opened position.

39. The combination of claim 38 in which said normally-closed outlet opening in the ring is covered by a tamper indicating sealing disc.

40. The combination of claim 37 in which the said guides have edges exposed at said outlet passages, said outlet valve having peripheral projections for engaging with said edges at each passage.

41. The combination of claim 38 in which the said outlet valve is of disk-like form with a downwardly-opening probe-receiving socket at its lower side and a tool-receiving slot at its upper side.

42. In combination a container for liquid having a projecting neck through which the liquid contents is to be dispensed and a dispenser having a reservoir for receiving said liquid when the container is inverted thereon;

a cap and outlet valve assembly in said neck, said assembly comprising a cap carrying a guide structure and an annular slider outlet valve, said slider valve being mounted for sliding movement along said guide structure between a normally-closed position and an opened position; said guide structure having a length, being mounted on said cap and extending into the neck, means forming elongated outlet passages along said length, said guide structure comprising at least two arcuate surfaces engaging said slider outlet valve, said slider outlet valve having a length of substantially lesser extent than said passages to permit flow through said passages as the valve moves toward said opened position, a socket and inlet valve assembly mounted in cooperation with said reservoir, said socket and inlet valve assembly comprising an upwardly-opening neck-receiving socket having an axis which receives the neck of said container when inverted, said inlet valve including a valve stem carrying a valve body which is normally biased to closed position, a reservoir inlet leading from the said upwardly-opening socket into said reservoir and closed by said valve body when in closed position, a probe coaxially mounted with an extending upwardly in said upwardly-opening socket, said slider valve stem being axially slidably mounted in said probe, said valve stem projecting upwardly from the probe so as to engage said slider outlet valve in the container neck when the neck is inverted in the upwardly-opening socket to move said slider outlet valve into said opened position, engagement of the stem with said slider outlet valve also moving the stem downwardly in said probe to move said valve body carried thereby into said opened position from said normally-biased closed position, said probe including an upstanding tubular support in said upwardly-opening neck-receiving socket that has the said valve stem mounted therein for downward movement, a valve seat on said support, around said inlet into said reservoir said inlet valve body being carried by said stem for normally seating upwardly on said valve seat on said support, said support having inlet means above said valve seat, said probe having a head mounted on said upstanding support, said slider outlet valve have a downwardly-opening socket, said head being adapted to fit in said downwardly opening socket in said slider outlet valve, said upwardly projecting stem also extending into said slider outlet valve socket before the probe head enters therein upon insertion of the container neck in said neck-receiving socket, said probe having finger-engaging locking means, and locking fingers carried by said slider outlet valve for engaging said locking means as it is pushed into said opened position by said stem and probe head, said locking means being on said probe head and being engaged by inwardly projecting locking lugs on said fingers, said guide structure comprising guides carried by an outer ring which has an outlet opening, said fingers being normally biased to engage said ring and hold the outlet valve in closed position, said ring having a cam surface for moving the locking lugs into locking engagement with said finger-engaging locking means on the probe head as the probe head enters said downwardly-opening outlet valve socket.

43. The combination of claim 42 in which the downwardly-opening socket of the slider outlet valve and the said probe head have interengaging means tending to hold the probe head in the valve socket.

44. The combination of claim 42 in which the said neck-receiving socket and inlet valve assembly includes an adaptor of funnel shape having a flared socket portion leading into a container neck-receiving portion of tubular form adapted to fit the said tubular neck of a container, said inlet valve being disposed in said tubular neck-receiving portion for controlling said inlet which leads therefrom into the reservoir.

45. The combination of claim 44 in which the adaptor is provided with an open air chamber, a filter for inlet air located in said chamber and a check valve connected to said reservoir for closing when the liquid in the reservoir reaches a selected level.

46. The combination of claim 44 in which said reservoir has an annular wall and opens upwardly, and means on the reservoir engaging said adaptor for centering said adaptor relative to said reservoir annular wall, said tubular neck-receiving portion extending into said reservoir concentric with said annular wall.

47. The combination of claim 46 in which the adaptor has a depending annular skirt which depends into said reservoir and is concentric with said annular wall so that there is an annular spaced between said skirt and said wall, and means disposed in said space for sealing said space.

48. The combination of claim 47 in which said sealing means is in the form of a flexible gasket expandable into tight engagement with the annular skirt and annular wall, and means for expanding the gasket, said expanding means comprising means for producing relative axial movement between the annular skirt on the socket member and the annular wall of the reservoir.

49. The combination of claim 48 in which said means for producing relative axial movement includes reversely-inclined cams carried by the said annular skirt and the said annular wall of the reservoir.

50. The combination of claim 47 in which the gasket is of C cross-section with upper and lower flexible sides which are compressed towards each other in expanding the gasket between said annular skirt and said annular wall.

51. The combination of claim 49 in which said gasket has flexible upper and lower sides and is non-rotatably positioned on the said annular skirt by a positioning ring located at a fixed axial position thereon and which engages the gasket at its lower side and a gasket-compressing ring fixed axially relative to said annular wall of the reservoir and surrounding said skirt to permit axial movement of the skirt relative to said ring and engaging the gasket at the said upper side.

52. In combination a container for liquid having a projecting neck through which the liquid contents is to be dispensed and a dispenser having a reservoir for receiving said liquid when the container is inverted thereon;

a cap and outlet valve assembly in said neck, said assembly comprising a cap carrying a guide structure and a slider outlet valve, said slider valve being mounted for sliding movement along said guide structure between a normally-closed position and an opened position; said guide structure having a length, being mounted on said cap and extending into the neck, means forming elongated outlet passages along said length, said slider outlet valve having a length of substantially lesser extent than said passages to permit flow through said passages as the valve moves toward said opened position, a socket and inlet valve assembly mounted in cooperation with said reservoir, said socket and inlet valve assembly comprising an upwardly-opening neck-receiving socket having an axis which receives the neck of said container when inverted, said inlet valve including a valve stem carrying a valve body which is normally biased to closed position, a reservoir inlet leading from the said upwardly-opening socket into said reservoir and closed by said valve body when in closed position, a probe coaxially mounted with and extending upwardly in said upwardly-opening socket, said valve stem being axially slidably mounted in said probe, said valve stem projecting upwardly from the probe so as to engage said slider outlet valve in the container neck when the neck is inverted in the upwardly-opening socket to move said slider outlet valve into said opened position, engagement of the stem with said slider outlet valve also moving the stem downwardly in said probe to move said valve body carried thereby into said opened position from said normally-biased closed position, said neck-receiving socket and inlet valve assembly including an adaptor of funnel shape having a flared socket portion, a container neck-receiving portion of tubular form adapted to fit the said tubular neck of a container leading from said flared socket portion, said inlet valve being disposed in said tubular neck-receiving portion for controlling said inlet which leads therefrom into the reservoir, said probe support is in the form of a tube upstanding from said inlet leading into said reservoir, said valve body seating upwardly around said inlet, and biasing means being in the form of a compression spring normally urging said valve stem upwardly to seat said valve body.

53. In combination a container for liquid having a projecting neck through which the liquid contents is to be dispensed and a dispenser having a reservoir for receiving said liquid when the container is inverted thereon;

a cap and outlet valve assembly in said neck, said assembly comprising a cap carrying a guide structure and an annular slider outlet valve, said slider outlet valve being mounted for sliding movement along said guide structure between a normally-closed position and an opened position; said guide structure having a length, being mounted on said cap and extending into the neck means forming elongated outlet passages along said length, said slider outlet valve having a length of substantially lesser extent than said passages to permit flow through said passages as the valve moves toward said opened position, a socket and inlet valve assembly mounted in cooperation with said reservoir, said socket and inlet valve assembly comprising an upwardly-opening neck-receiving socket having an axis which receives the neck of said container when inverted, said inlet valve including a valve stem carrying a valve body which is normally biased to closed position, a reservoir inlet leading from the said upwardly-opening socket into said reservoir and closed by said valve body when in closed position, a tubular probe coaxially mounted with and extending upwardly in said upwardly-opening socket from said inlet, said valve stem being axially slidably mounted in said probe, said valve stem projecting upwardly from the probe so as to engage said slider outlet valve in the container neck when the neck is inverted in the upwardly-opening socket to move said slider outlet valve into said opened position, engagement of the stem with said slider outlet valve also moving the stem downwardly in said probe to move said valve body carried thereby into said opened position from said normally-biased closed position, said neck-receiving socket and inlet valve assembly including an adaptor of funnel shape having a flared socket portion, a container neck-receiving portion of tubular form adapted to fit the said tubular neck of a container leading from said flared socket portion, said inlet valve being disposed in said tubular neck-receiving portion for controlling said inlet which leads therefrom into the reservoir, said probe having a head of annular form, outlets disposed around the probe head leading into said tubular probe support, said probe head having a tapered lower surface for directing liquid from said outlet into said tubular support.

* * * * *